US006145905A

United States Patent [19]

Carpenito

[11] Patent Number: 6,145,905

[45] Date of Patent: Nov. 14, 2000

[54] CUP HOLDERS

[76] Inventor: Thomas A. Carpenito, 72 Grant Ave., White Plains, N.Y. 10603

[21] Appl. No.: 09/349,875

[22] Filed: Jul. 8, 1999

[51] Int. Cl.[7] ..... A47G 19/00; B65D 1/34

[52] U.S. Cl. ..... 294/159; 294/172; 206/565; 206/818; 220/23.83

[58] Field of Search ..... 294/32, 144, 159, 294/165, 172; 206/560, 564, 565, 818; 220/23.83; 211/DIG. 1

[56] References Cited

U.S. PATENT DOCUMENTS

| | | | |
|---|---|---|---|
| 1,962,556 | 6/1934 | Eberhardt, Jr. | 294/172 |
| 2,107,744 | 2/1938 | Solomon . | |
| 2,217,514 | 10/1940 | Henry | 206/818 |
| 2,346,582 | 4/1944 | Insler et al. | 211/DIG. 1 |
| 2,704,928 | 3/1955 | Curry . | |
| 2,845,207 | 7/1958 | Klinghoffer . | |
| 3,442,378 | 5/1969 | Wolfe | 206/565 |
| 3,526,334 | 9/1970 | Ashton et al. . | |
| 3,610,459 | 10/1971 | Hanson . | |
| 3,951,259 | 4/1976 | Oglesbee . | |
| 4,133,466 | 1/1979 | Rosen | 294/144 |
| 5,560,480 | 10/1996 | Singleton . | |
| 5,873,486 | 2/1999 | Morgan . | |
| 5,899,515 | 5/1999 | Burns | 294/159 |

FOREIGN PATENT DOCUMENTS

| | | | |
|---|---|---|---|
| 443-951 | 8/1991 | European Pat. Off. | 294/172 |
| 3-187881 | 8/1991 | Japan | 206/818 |
| 294298 | 7/1928 | United Kingdom | 206/818 |

*Primary Examiner*—Dean J. Kramer
*Attorney, Agent, or Firm*—Mark P. Stone

[57] ABSTRACT

A cup holder includes a paddle-shaped structure having handles extending from opposed ends. The top surface of the paddle includes one or more ports for accommodating a magnet. Cups including a magnetic element are removably seated in the corresponding ports on the paddle surface, and two or more individuals can simultaneously drink from separate cups carried by the paddle by tilting the paddle by the opposed handles.

10 Claims, 1 Drawing Sheet

CUP HOLDERS

BACKGROUND OF THE INVENTION

The present invention is directed to an apparatus for removably retaining one or more cups on a single, movable supporting surface. In particular, the device in accordance with the present invention permits two or more individuals to simultaneously drink from two more more separate cups supported on a single tiltable element.

Known devices for holding cups or containers are exemplified by the following United States patents: U.S. Pat. Nos. 2,107,744; 2,704,928; 2,845,207; 3,526,334; 3,610,459; 3,951,259; 5,560,480; and 5,873,486.

It is the primary object of the present invention to provide an improved apparatus for removably retaining a plurality of cups on a single, movable supporting surface to permit a plurality of individuals to simultaneously drink from separate cups. The device in accordance with the present invention therefore provides both means for removably retaining one or more cups on a single support surface, and means for permitting a plurality of individuals to simultaneously drink from a plurality of separate cups removably retained on the supporting surface.

Other objects and advantages of the device in accordance with the present invention will become apparent from the following description.

SUMMARY OF THE INVENTION

A supporting element, preferably a longitudinally extending paddle-shaped element, defines a substantially planar upper surface. One or more ports are defined on the upper surface, and each port is adapted to receive means for removably retaining a cup or container upright in the port. Preferably, the retaining means comprises a magnetic element mounted in each port, and cooperating magnetic materials mounted in the base of each cup or container to be removably retained in each port. However, other suitable retaining means can also be used.

Handles extend from the opposed longitudinal ends of the supporting element. In this manner, the supporting element can be both raised and tilted by manual manipulation of the opposed handles by one or more persons. The means for retaining the containers in the ports is sufficiently strong to assure that the containers do not disengage from the supporting element when the supporting element is tilted or inverted.

The lower surface of the supporting element is substantially planar, and includes supporting means. Preferably, the supporting element is generally rectangular in configuration, and a supporting foot is provided in each of the corners of the lower surface of the supporting element.

In the preferred embodiments of the invention, the paddle and the handles are formed from wood. However, other materials, such as plastics, can be suitably used in connection with the invention.

DESCRIPTION OF THE BEST MODES FOR CARRYING OUT THE INVENTION

Figure 1:
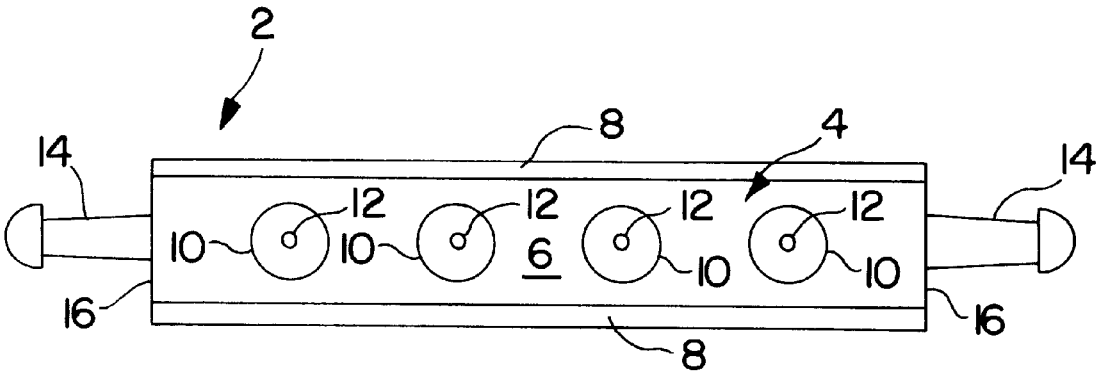
FIG. 1 is a top plan view of a device for removably supporting containers in accordance with the present invention.
Figure 2:
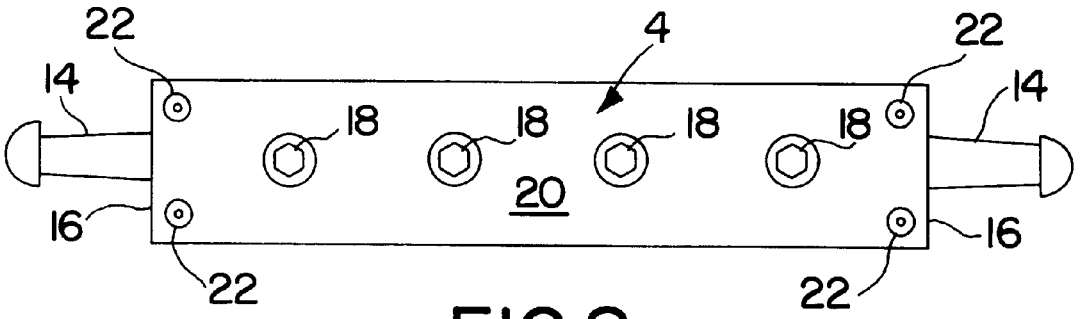
FIG. 2 is a bottom plan view of the device illustrated by FIG. 1.
Figure 3:
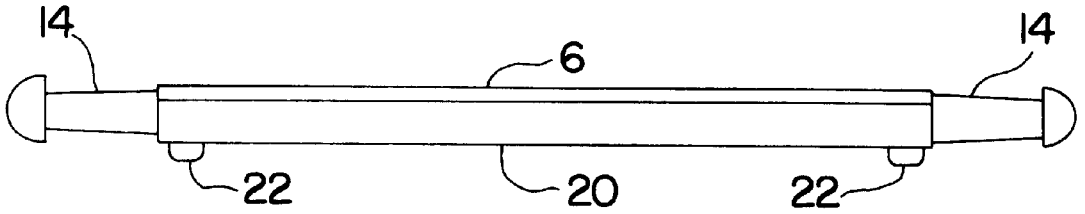
FIG. 3 is a side elevational view of the device illustrated by FIG. 1.

FIGS. 1–3 illustrate an exemplary embodiment of a movable container supporting device in accordance with the present invention.

The device, generally designated by reference numeral 2, includes a substantially rectangular-shaped supporting element designated by reference numeral 4. The supporting element extends longitudinally, and is preferably a paddle-shaped element. The top surface of the supporting element 4 is designated by reference numeral 6. The opposed longitudinal edges of the top surface 6 are chamfered, as is illustrated by reference numeral 8.

A plurality of ports designated by reference numeral 10 are defined on the top surface of the supporting element. Although FIG. 1 illustrates four ports, this has been done for illustrative purposes only. The top surface can also define a single port, or any number of a plurality of ports. A retaining element, designated by reference numeral 12, is mounted within each of the ports 10. In the preferred embodiment of the invention, the retaining element 12 is a magnet, and it cooperates with a magnetic element in a cup or container removably mounted in a port 10, as will be discussed in greater detail below. However, other retaining means can be used in conjunction with the present invention, as for example, complementary adhesive strips (e.g., VELCRO adhesive strips) mounted in the port 10 and on the based of a container removably received within the port. Other types of suitable retaining means include twist locking elements (i.e.—complementary bayonet-type locking elements arranged in the ports and on the containers), and complementary screw threads defined in the ports and carried on the removable containers (e.g., on sleeves attached to the bottom of the containers).

Still referring to FIG. 1 of the drawing, handle elements 14 extend from opposed ends 16 of the supporting element 4. The handle elements permit one or more individuals to manually elevate the supporting element and, thereafter, to selectively tilt the supporting element to permit one or more individuals to simultaneously drink from one or more separate cups retained within one or more of the ports 10 defined on the supporting element 4. Although the handles are illustrated in a knob-type configuration, other handle configurations are within the scope of the present invention.

FIG. 2 illustrates a bottom plan view of the device illustrated by FIG. 1. Reference numeral 18 designates means for retaining each magnetic element 12 in each port 10. The retaining elements 18 can include flat washers and machine screws, or other suitable retaining means for the magnetic elements in the ports. Reference numeral 20 designates a substantially planar lower surface of the supporting element 4. A plurality of supporting feet 22 are mounted to the corners of the lower surface 20 for supporting the lower surface a predetermined distance above a supporting surface, as for example, the top of a bar or a counter.

FIG. 3 illustrates a side elevational view of the device illustrated by FIGS. 1 and 2. The device is shown in its upright position, as it would be when it is resting on a supporting surface.

Preferably, the supporting element 4 and the opposed handles 14 are formed from wood. However, these elements can be formed from other materials, as for example, plastic.

In operation, the device 2 is supported in its upright position, as illustrated by FIG. 3, resting on a supporting surface, as for example, the top of a bar or counter. Cups or containers containing beverages to be consumed are removably retained within one or more ports 10 in a substantially upright position. One or more individuals manually engage the opposed extending handles 14 to initially elevate the device with the cups or containers continuing to be oriented in a substantially upright position. Thereafter, when the device is raised to the level of the mouths of the individuals desiring to consume the beverages from the containers, the supporting element 4 is tilted towards the individuals by rotating the handle 14 towards the individuals, and the individuals can simultaneously consume the contents of the separate cups or containers removably retained within the ports 10. The retaining means provide a sufficient retaining force so that the cups or containers remain retained within the respective ports even when the device is tilted. One or more cups or containers may be removed from their respective ports by exerting an opposed force thereon greater than the force exerted by the magnetic (or other) retaining means.

The handles 14 can be rotated by one or more of the individuals desiring to consume the contents of the containers, or other individuals can rotate the handle for the persons desiring to consume the contents of the cups or containers. Moreover, it is within the scope of the present invention to provide a device in which only a single cup or container is removably received within only a single port on the upper surface of the supporting element, and this individual can himself rotate the handles, or the handles can be rotated for him by one or more other individuals. However, in the preferred embodiment of the invention, at least two ports are provided so that at least two individuals can simultaneously consume beverages from at least two different cups retained within the separate ports.

The description of the preferred embodiment of the invention herein is intended to be illustrative only, and not restrictive of the scope of the invention. For example, the device can be formed from materials other than those described herein, and retaining means other than those described herein can be employed. Accordingly, the discussion herein is intended to be illustrative only, and not restrictive of the scope of the invention, that scope being defined by the following claims and all equivalents thereto.

What is claimed is:

1. A device for supporting at least one container, said device comprising a longitudinally extending supporting element defining an upper surface and two opposed ends; a handle element extending from each of said opposed ends; at least one port defined in said upper surface; and means for removably retaining at least a portion of a container for holding a beverage to be consumed within a volume of space defined by said least one port, said means for removably retaining including a magnetic element in said at least one port.

2. The device as claimed in claim 1 further including a plurality of ports defined in said upper surface of said supporting element.

3. The device as claimed in claim 2 wherein said supporting element is formed from wood.

4. The device as claimed in claim 2 wherein said opposed handles are formed from wood.

5. The device as claimed in claim 1 wherein said supporting element defines a lower surface, and at least one supporting leg extends downwardly from said lower surface.

6. The device as claimed in claim 5 wherein said supporting element is generally rectangular shaped, said lower surface defines four corners, and one of said supporting legs is mounted to each of said four corners.

7. A device for supporting at least one container. said device comprising a longitudinally extending supporting element defining an upper surface and two opposed ends; a handle element extending from each of said opposed ends; at least one port defined in said upper surface of said supporting element; and means for removably retaining a container for holding a beverage to be consumed in said at least port, wherein said means for removably retaining includes an adhesive strip in said at least one port.

8. A device for supporting a plurality of containers, said device comprising a generally rectangular shaped supporting element; said supporting element defining a top surface and two opposed ends; a handle element extending from each of said opposed ends; said top surface defining a plurality of ports; and means in each of said plurality of ports for removably retaining at least a portion of a container within a volume of space defined by each of said plurality of ports; wherein said means for removably retaining includes a magnet mounted in each of said plurality of ports, said magnet adapted to cooperate with a magnetic element on a container to be removably received within said port.

9. The device as claimed in claim 8 wherein said supporting element defines a substantially planar lower surface, and a plurality of supporting legs mounted to said lower surface and extending downwardly therefrom.

10. A device for supporting a plurality of containers, said device comprising a generally rectangular shaped supporting element; said supporting element defining a top surface and two opposed ends; a handle element extending from each of said opposed ends; said top surface defining a plurality of ports; and means in each of said plurality of ports for removably retaining a container in each of said plurality of ports; wherein said means for removably retaining includes an adhesive strip in each of said plurality of ports, said adhesive strip adapted to cooperate with an adhesive strip on a container to be removably received within said port.

* * * * *